US005118353A

United States Patent [19]

Tilby

[11] Patent Number: 5,118,353

[45] Date of Patent: Jun. 2, 1992

[54] MOVING SCREEN APPARATUS AND METHOD FOR SEPARATION OF SUGARCANE PITH FROM RIND

[76] Inventor: Sydney E. Tilby, 4688 Boulderwood Dr., Victoria, B.C., Canada, V8Y 2P8

[21] Appl. No.: 637,350

[22] Filed: Jan. 4, 1991

[51] Int. Cl.[5] ..... B02C 17/02; B02C 23/10

[52] U.S. Cl. ..... 127/2; 241/14; 241/79

[58] Field of Search ..... 127/2; 241/236, 14, 241/79, 69, 235, 155, 157; 460/24, 113; 209/13

[56] References Cited

U.S. PATENT DOCUMENTS

| | | | |
|---|---|---|---|
| 605,293 | 6/1898 | Madden | 241/222 |
| 608,630 | 8/1898 | Wright | 241/222 |
| 616,177 | 12/1898 | Adelsperger | 241/222 |
| 623,753 | 3/1899 | Winchell | 241/222 |
| 623,754 | 3/1899 | Winchell | 241/222 |
| 627,882 | 6/1899 | Sherwood | 241/222 |
| 632,789 | 9/1899 | Remy | 241/222 |
| 657,341 | 9/1900 | Dyer | 241/222 |
| 670,037 | 3/1901 | Sherwood | 241/222 |
| 675,758 | 6/1901 | Sherwood | 241/222 |
| 684,492 | 10/1901 | Adamson | 241/222 |
| 707,531 | 8/1902 | Adamson | 241/222 |
| 1,689,387 | 10/1928 | Heimlich | 241/222 |
| 2,706,312 | 4/1955 | Bobkowicz | 19/7 |
| 3,424,611 | 1/1969 | Miller | 127/2 |
| 3,424,612 | 1/1969 | Miller | 127/2 |
| 3,464,877 | 9/1969 | Miller et al. | 156/259 |
| 3,464,881 | 9/1969 | Miller et al. | 161/60 |
| 3,566,944 | 3/1971 | Tilby | 146/222 |
| 3,567,510 | 3/1971 | Tilby et al. | 99/2 |
| 3,567,511 | 3/1971 | Tilby | 127/43 |
| 3,690,358 | 9/1972 | Tilby | 146/119 |
| 3,698,459 | 10/1972 | Tilby | 146/119 |
| 3,721,567 | 3/1973 | Miller et al. | 99/2 ND |
| 3,796,809 | 3/1974 | Miller et al. | 426/2 ND |
| 3,873,033 | 3/1975 | Tilby | 241/19 |
| 3,976,498 | 8/1976 | Tilby | 127/2 |
| 3,976,499 | 8/1976 | Tilby | 127/42 |
| 4,025,278 | 5/1977 | Tilby | 425/404 |
| 4,151,004 | 4/1979 | Vukelic | 127/2 |
| 4,312,677 | 1/1982 | Tilby et al. | 127/2 |
| 4,572,741 | 2/1986 | Mason | 127/2 |
| 4,636,263 | 1/1987 | Cundiff | 241/222 |
| 4,702,423 | 10/1987 | Pinto | 241/60 |
| 4,743,307 | 5/1988 | Mason | 127/2 |
| 4,816,075 | 3/1989 | Gruenewald | 127/2 |

*Primary Examiner*—Theodore Murry
*Assistant Examiner*—P. L. Hailey
*Attorney, Agent, or Firm*—Jansson & Shupe, Ltd.

[57] ABSTRACT

An improved apparatus and method for separating milled sugarcane pith from flattened rind upon discharge from a depithing station. The method includes dividing the discharge using an endless moving screen in the discharge zone, the screen having an open mesh which is suitable to allow flow of milled pith therethrough and to carry depithed rind thereon. Preferred embodiments include apparatus associated with the endless screen for pith collection and removal, and downstream apparatus for removing pith in a secondary pith flow from the path of rind flow and diverting it to the primary pith flow.

21 Claims, 5 Drawing Sheets

MOVING SCREEN APPARATUS AND METHOD FOR SEPARATION OF SUGARCANE PITH FROM RIND

FIELD OF THE INVENTION

This invention is related generally to methods and apparatus for processing sugarcane and the like and, more particularly, to methods and apparatus for separation of stalks into their rind and pith constituents.

BACKGROUND OF THE INVENTION

The stalk of the sugarcane plant includes an outer rind which is a hard, wood-like fibrous substance. The rind surrounds a central core of pith, which bears nearly all of the sugar juice from which various sugar products are made. The outer surface of the rind has a thin, waxy epidermal layer, referred to herein as "dermax."

Certain other plants (e.g., sweet sorghum) are similar to sugarcane in that they are grasses having woody grass stalks. While there is frequent reference herein to sugarcane, it is to be understood that this invention applies to processing of woody grass stalks like sugarcane and sweet sorghum or certain of their constituents. At no point, including the claims, is any reference to sugarcane to be limiting.

Conventional sugarcane industry practices until today have utilized sugarcane primarily only for its sugar content. Such industry practices have involved chopping and crushing sugarcane stalks to remove the sugar juice, with the waste solids (bagasse) being used primarily only as fuel, mainly in sugar production operations.

Although such practices have been virtually uniform throughout the industry, it has been recognized that a number of very useful products may be produced from sugarcane if the sugarcane stalk is first separated into its rind, pith and dermax constituents. The many useful end-products made possible by such separation can provide great economic benefit. Such separation also provides significant efficiencies in the production of sugar.

Earlier efforts involving stalk separation, though not necessarily related to sugarcane, are reflected in the following United States patents:

U.S. Pat. No. 605,293 (Madden)
U.S. Pat. No. 608,630 (Wright)
U.S. Pat. No. 616,177 (Adelsperger)
U.S. Pat. No. 623,753 (Winchell)
U.S. Pat. No. 623,754 (Winchell)
U.S. Pat. No. 627,882 (Sherwood)
U.S. Pat. No. 632,789 (Remy)
U.S. Pat. No. 657,341 (Dyer)
U.S. Pat. No. 670,037 (Sherwood)
U.S. Pat. No. 675,758 (Sherwood)
U.S. Pat. No. 684,492 (Adamson)
U.S. Pat. No. 707,531 (Adamson)
U.S. Pat. No. 1,689,387 (Heimlich)
U.S. Pat. No. 2,706,312 (Bobkowicz).

Even though stalk separation efforts began as early as the late 1800's, essentially the entire sugarcane industry continued in the conventional process noted above, involving chopping and crushing of the whole stalk to extract sugar juice.

Technology in this field remained rather dormant until the 1960's, when a resurgence of development activity began, substantially all related to what has been known in the industry as the Tilby system, a cane separation system named after the principal originator, Sydney E. ("Ted") Tilby.

Broadly speaking, the Tilby system includes a multistep operation executed by various portions of a cane separator machine. Sugarcane billets, i.e., cut lengths of cane stalk preferably about 25–35 cm long, are driven downwardly over a splitter to divide them lengthwise into semi-cylindrical half billets. The two half billets of a split billet are then processed individually by symmetrical downstream portions of the separator machine.

The first of such downstream portions of the separator is a depithing station which includes a cutter roll and holdback roll for milling pith away from the rind of the half-billet while simultaneously flattening the rind. The next downstream portion is a dermax removal station from which the rind emerges ready for subsequent processing in a variety of ways, including slitting, chipping and/or many other processing steps. The pith is conveyed away from the separator machine to an extraction station where its sugar juice is removed.

A significant number of patents related to the Tilby system and improvements in such system have been granted, beginning in the 1960's. These and other fairly recent United States patents related generally to sugarcane processing are as follows:

U.S. Pat. No. 3,424,611 (Miller)
U.S. Pat. No. 3,424,612 (Miller)
U.S. Pat. No. 3,464,877 (Miller et.al.)
U.S. Pat. No. 3,464,881 (Miller et.al.)
U.S. Pat. No. 3,566,944 (Tilby)
U.S. Pat. No. 3,567,510 (Tilby)
U.S. Pat. No. 3,567,511 (Tilby)
U.S. Pat. No. 3,690,358 (Tilby)
U.S. Pat. No. 3,698,459 (Tilby)
U.S. Pat. No. 3,721,567 (Miller et.al.)
U.S. Pat. No. 3,796,809 (Miller et.al.)
U.S. Pat. No. 3,873,033 (Tilby)
U.S. Pat. No. 3,976,498 (Tilby)
U.S. Pat. No. 3,976,499 (Tilby)
U.S. Pat. No. 4,025,278 (Tilby)
U.S. Pat. No. 4,151,004 (Vukelic)
U.S. Pat. No. 312,677 (Tilby et.al.)
U.S. Pat. No. 4,572,741 (Mason)
U.S. Pat. No. 4,636,263 (Cundiff)
U.S. Pat. No. 4,702,423 (Pinto)
U.S. Pat. No. 4,743,307 (Mason)
U.S. Pat. No. 4,816,075 (Gruenewald).

The Tilby system, when finally fully commercialized, can provide substantial outputs of several high-value products. This greatly increases cash yields per ton of sugarcane, a factor of significant importance to an industry in which profitability in recent years has been marginal at best. This is important generally, but is of particular importance to the many developing countries in which a flourishing sugarcane industry would be a boon to economic growth and stability.

Considering that sugarcane is one of the most rapidly growing, easily developed, and readily accessible sources of biomass, full commercialization of the Tilby system can significantly reduce dependence on forests and on certain other crops and resources. Among the products which can be made from sugarcane constituents separated by the Tilby system are sugar in an increased variety of forms, foods and food additives, animal feeds, a variety of wood products and building materials, alcohol for a variety of purposes, paper and other pulp-containing products, and a variety of specialty products.

While substantial technical development has occurred over a period of many years with respect to the Tilby system, a number of difficult and critical problems have remained. The failure to overcome such problems has prevented full commercialization of the Tilby system. The invention described and claimed herein is directed to the solution of certain of these problems.

Specific Background

One significant problem relates to establishment of separate flows of milled pith and flattened rind after the depithing operation performed between the cutter and holdback rolls. Milled pith and flattened rind are, of course, processed separately for separate purposes, and the efficiencies of the operation slip to the extent that milled pith stays with flattened rind or otherwise fails to reach the line for subsequent processing of milled pith.

Related to this is the additional problem of system jamming which can occur if flattened rind does not flow freely away from the pith-milling station but instead gets "hung-up." Such jamming is more prone to occur if certain steps are taken for the important purpose of assuring that the milled pith stays together in a single stream.

The normal approach to achieving the latter purpose -- that is, keeping the flow of milled pith together, may involve placing a deflector element close as possible to the nip (i.e., the common tangent line or near-tangent zone) of the cutter and holdback rolls and making its upstream edge as sharp as possible to allow it to be crowded very close to the nip. But such crowding and sharp edge exacerbate the problem of jamming, tend to allow a buildup of pith and rind fibers on the edge, and even allow some rind pieces to pass into the flow of milled pith.

Furthermore, given the desirability of cutter and holdback roll sets of large axial dimension in order to accommodate commercially-viable high throughputs, it has been found impractical to hold the fine tolerances required to keep a sharp upstream edge of a deflector properly positioned along a line crowded toward the nip. Placement close to the nip would seem to be facilitated by reducing the radial dimensions of the cutter and holdback rolls. But reducing even radial dimensions is not consistent with higher throughputs, and even tends to cause problems involving half-billets failing to properly enter the depithing station.

Various improvements have been devised to address problems related to achieving good division of the material discharged from the depithing station into separate pith and rind flows. For example, U.S. Pat. No. 3,976,498 (Tilby et.al.) discloses the concept of using a deflector with an upstream edge having a smooth rounded profile. While this provided some relief, many of the above problems continued. And, the rounding of the upstream edge of the deflector allowed more milled pith to pass with the rind flow to the dermax-removing station, where its valuable juice content was lost.

The continuing problems led to the improvement disclosed in later U.S. Pat. No. 4,151,004 (Vukelic), which discloses a rotating deflector edge device using a moving part to avoid accumulation of fibers on the deflector. Such device is impractical for a number of reasons and failed to fully address the above-noted problems. It has not been developed further. It is noteworthy that this later patent was held by the entity holding U.S. Pat. No. 3,976,498; this shows the inadequacy of the earlier rounded-profile concept as a complete commercially-acceptable solution to the above-noted problems.

OBJECTS OF THE INVENTION

It is an object of this invention to provide a method and apparatus for separating sugarcane pith from sugarcane rind which overcome the shortcomings and problems of the prior art, including those mentioned above.

Another object of this invention is to provide an improved method and apparatus for separating the milled pith from flattened rind as such materials are discharged from the depithing station.

Another object of this invention is to provide an improved apparatus and method which elminate jamming of the discharge of the depithing station.

Another object of this invention is to provide an improved apparatus and method for sugar which avoid waste of any portion of the discharge from the depithing station and thereby increase efficient use of the constituents to sugarcane, sweet sorghum and the like.

Still another object of this invention is to solve the above-noted problems in a manner readily applicable to large-scale commercial equipment having substantial throughput rates.

These and other important objects will be apparent from the descriptions of this invention which follow.

SUMMARY OF THE INVENTION

The method and apparatus of this invention overcome the above-noted problems and are useful in large-scale commercial sugarcane and sweet sorghum separation operations.

This invention is based in part on the realization that, contrary to previous thinking, it is not necessary to fully separate the milled pith and flattened rind into separate flows immediately at the point of discharge from the depithing station. Instead, while care is taken to be sure that half-billet rinds flow only along a rind flow path, it is accepted that a significant amount of milled path will not enter a primary milled pith flow, but instead form a secondary milled pith flow which moves with the rind flow. Then, special accomodations are made such that the secondary milled pith flow quickly joins pith from the primary pith flow.

The method of this invention includes splitting sugarcane billets into half billets, milling pith from half billets by passing them between cutter and holdback rolls, and then dividing the discharge from such rolls into separate flows of pith and rind in a unique way -by interposing an endless moving screen in the discharge from such rolls, the screen having an open mesh suitable both to allow flow of milled pith therethrough and to carry depithed rind thereon. The endless moving screen is preferably a rotating hollow cylindrical screen member positioned with a pickup portion thereof in the discharge zone, with the screen in the pickup portion moving generally in the direction of discharge.

Such screen divides the discharge into a primary milled pith flow and a rind flow which includes a secondary milled pith flow. The method of the invention also includes subsequent removing of the secondary milled pith flow from the rind flow and diverting it to join pith from the primary pith flow.

In preferred embodiments, the removing and diverting step includes capturing the pith from the secondary pith flow in interstices formed within the bristle portion of a rotating brush roll which bristle portion merges with the secondary pith flow, holding such captured pith within the interstices through an arc of brush roll rotation to turn the secondary pith flow away from the rind flow, and finally releasing such captured pith from the interstices in a direction away from the rind flow. The releasing step is most preferably by means of the centrifugal force which is generated during brush roll rotation.

In highly preferred embodiments, the removing and diverting step includes capturing in a subsequent similar brush the pith from the secondary pith flow which is not captured by the previous brush. In other words, multiple brush rolls may be used in series.

It is highly preferred in such situations for one of the brush rolls to be rotated at a speed such that its bristle tips move along the rinds in the direction of rind flow at a linear speed in excess of the speed of the rind flow. This allows pith adhering to the rinds to be brushed off the rinds to join pith from the primary pith flow.

The apparatus of this invention includes an endless screen having a pickup portion which is positioned in the discharge zone of the depithing station, the screen having an open mesh as described above, and means to rotate the endless screen such that its movement in the discharge zone is substantially in the direction of discharge. The rind is received by and carried on the screen toward downstream release and pith passes through the screen toward a downstream pith collection point.

The endless screen, when in the preferred form of a rotatable hollow cylinder, is preferably positioned such that the discharge direction is generally tangential to the cylinder. This allows easy pickup of the rinds, and also allows the very high velocity discharge of pith impact the screen directly enough to easily enter the hollow cylinder.

Highly preferred embodiments have a fixed container inside the cylindrical screen member positioned for accumulation of pith. Such container has an opening for receiving pith through the screen member, while the cylindrical member has at least one open end for movement of pith out of the container.

Such embodiments preferably include means to move pith which has accumulated in the container along the axis of the cylindrical screen member to outside the cylindrical screen member. A preferred moving means is an auger in the container, the auger being substantially coaxial with the cylindrical screen member. In certain embodiments, there are two open ends and the auger is configured to move pith in different portions of the container in opposite directions toward both open ends.

Preferred embodiments have a gripping roll which is peripherally adjacent to the cylindrical screen member to hold rinds on the screen during their movement with the screen.

As already suggested with reference to the inventive method, preferred embodiments of the invention include means downstream of the endless screen for removing the secondary milled pith flow from the rind flow and diverting it to join pith from the primary pith flow.

A preferred removing and diverting means includes at least one rotatable brush roll downstream of the endless screen, each such brush roll having a bristle portion with interstices therein, such bristle portion positioned to merge on rotation with the secondary milled pith flow and receive pith into the interstices. In such preferred embodiments, there is a coacting feed roll for each brush roll, the rotation of such brush and feed rolls serving to advance rinds while the brush roll receives and captures pith as described.

The bristles of the brush rolls are preferably arranged in offset rows of bristle bunches. This facilitates the capturing of pith as it flows with the rind in a downstream direction.

Preferred embodiments also include, as part of the removing and diverting means, a divider downstream of each brush roll. Each such divider has a rind side and a pith side, the pith side being adjacent to the bristle portion along an arc extending away from the surface of the rind side.

The rind sides of the downstream dividers extend substantially along a common curved path, the bristle portions of each brush roll having bristle tips which project beyond such curved path, in position to facilitate capturing of pith moving in the path of rind flow.

As already noted, it is preferred to have a plurality of brush roll, feed roll, and divider sets, and in such cases to rotate one of the brush rolls at a speed such that its bristle tips move along &:he rinds in the direction of rind flow at a linear speed in excess of the speed of the rind flow. This allows removal of pith, as noted above. In such cases, the feed roll paired with such brush roll may be grooved to hold the rind from acceleration in the downstream direction during such brushing.

DETAILED DESCRIPTIONS OF PREFERRED EMBODIMENTS

Figure 1:
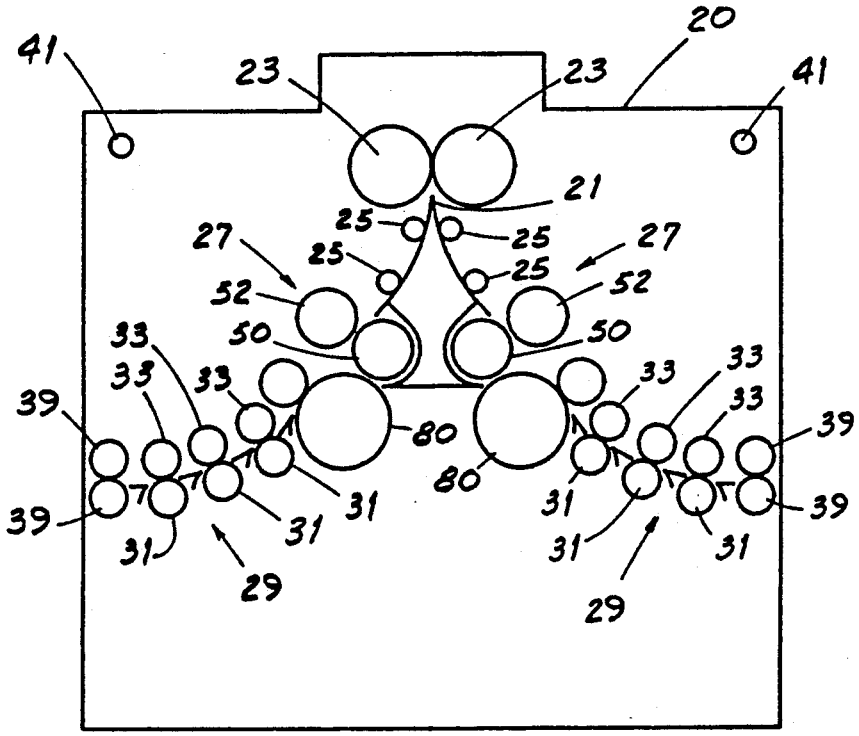
FIG. 1 is a schematic front elevation of a sugarcane separation unit in accordance with this invention.

FIG. 1 shows a tower-like separator unit 20 used for splitting and processing sugarcane billets. As known in the prior art, separator unit 20 is symmetrical in a "mirror-image" arrangement, the two sides serving to process the half-billets resulting from billet splitting. The two sides of separator unit 20, as is known in the prior art, include portions mounted on wings 37 which can pivot upwardly about pivots 41 to facilitate servicing of unit 20.

Separator unit 20 receives whole billets of sugarcane, sweet sorghum, or the like end-first from above. Such billets are forced downwardly onto a splitting knife 21 by a pair of feed rolls 23. This splits the billets longitudinally into half-billets. Each half-billet, with its interior pith now exposed, moves past rotating control brushes 25 into a depithing station 27. At depithing station 27, the sugar-bearing pith of the half-billet is cut away from the half-billet rind in fairly small pieces and, at the same time, such rind is flattened.

As indicated above, this invention relates to separation of the flow of cut ("milled") pith from the flow of flattened rinds. This is accomplished using the apparatus illustrated in detail in FIG. 2.

Figure 2:
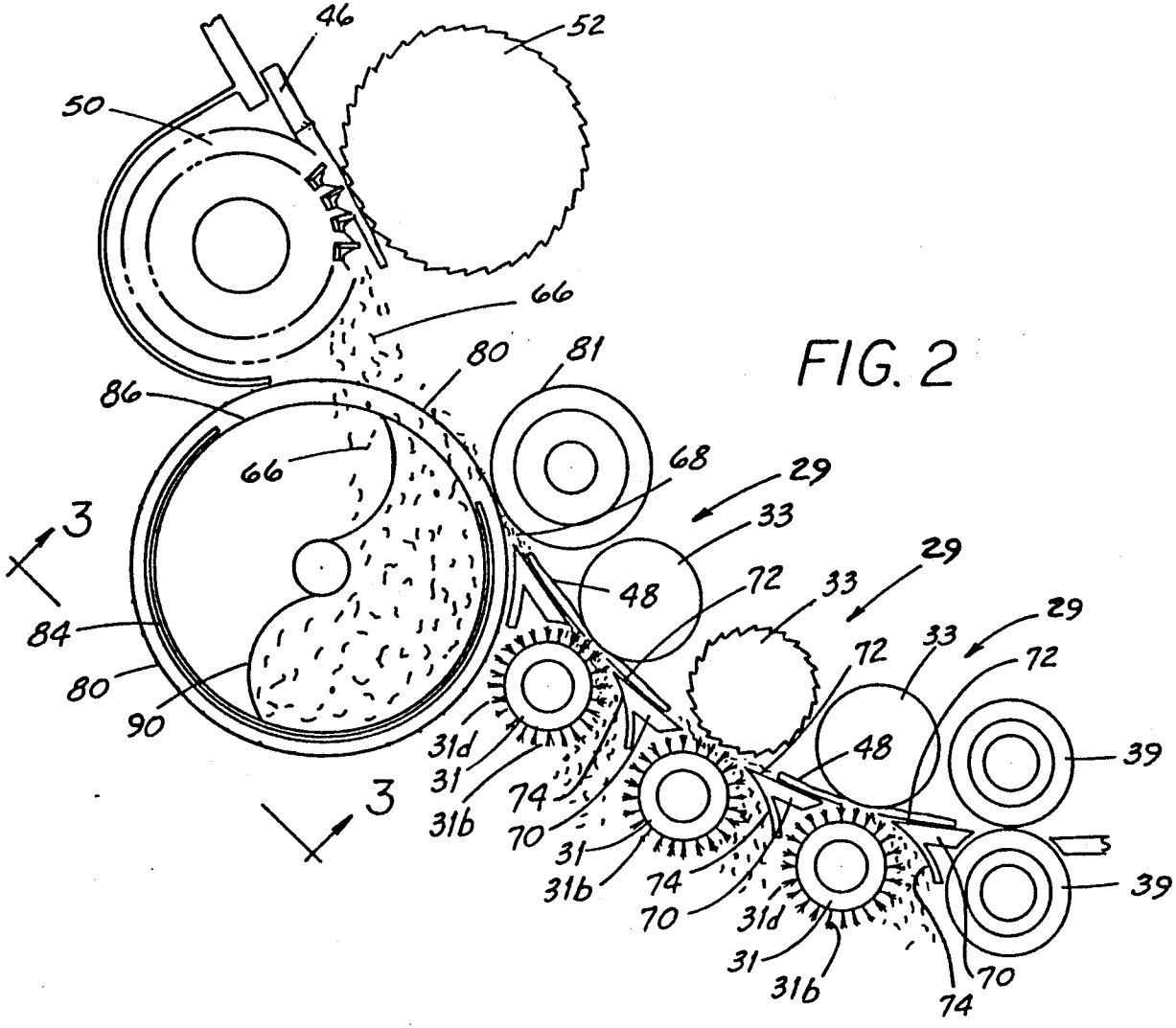
FIG. 2 is an enlarged view of a portion of FIG. 1, illustrating details of the invention.

As shown best in FIG. 2, each depithing station 27 includes a cutter roll 50 and a hold-back roll 52 between which half-billet 46 moves to be separated into milled pith and flattened rind 48, as well known in the art.

Downstream of cutter and hold-back rolls 50 and 52 is a rotating cylindrical screen 80 which is positioned in the discharge zone of rolls 50 and 52, and serves to divide the discharge from cutter and hold-back rolls 50 and 52 into a primary pith flow 66 and a rind flow. The rind flow has with it a secondary pith flow 68 which fails to go with primary pith flow 66.

Cylindrical screen 80 has an open mesh which, as noted above, is suitable to allow flow of milled pith through it and to carry depithed rind on it. The flow of milled pith passes readily through screen 80 in part because of the high velocity at which it is discharged from cutter and hold-back rolls 50 and 52. Some, however, will be carried by flattened rinds or by screen 80 rather than passing through screen 80; it is this which forms secondary milled pith flow 68.

Peripherally adjacent to rotatable screen 80 and coacting with it is a gripping roll 81. Gripping roll 81 serves to hold flattened rinds on screen 80 during their brief movement with screen. Gripping roll 81, which may be made of hard rubber, also tends to assure that the flattened rinds will leave screen 80 and move to pith-removal stations 29.

Figure 3:
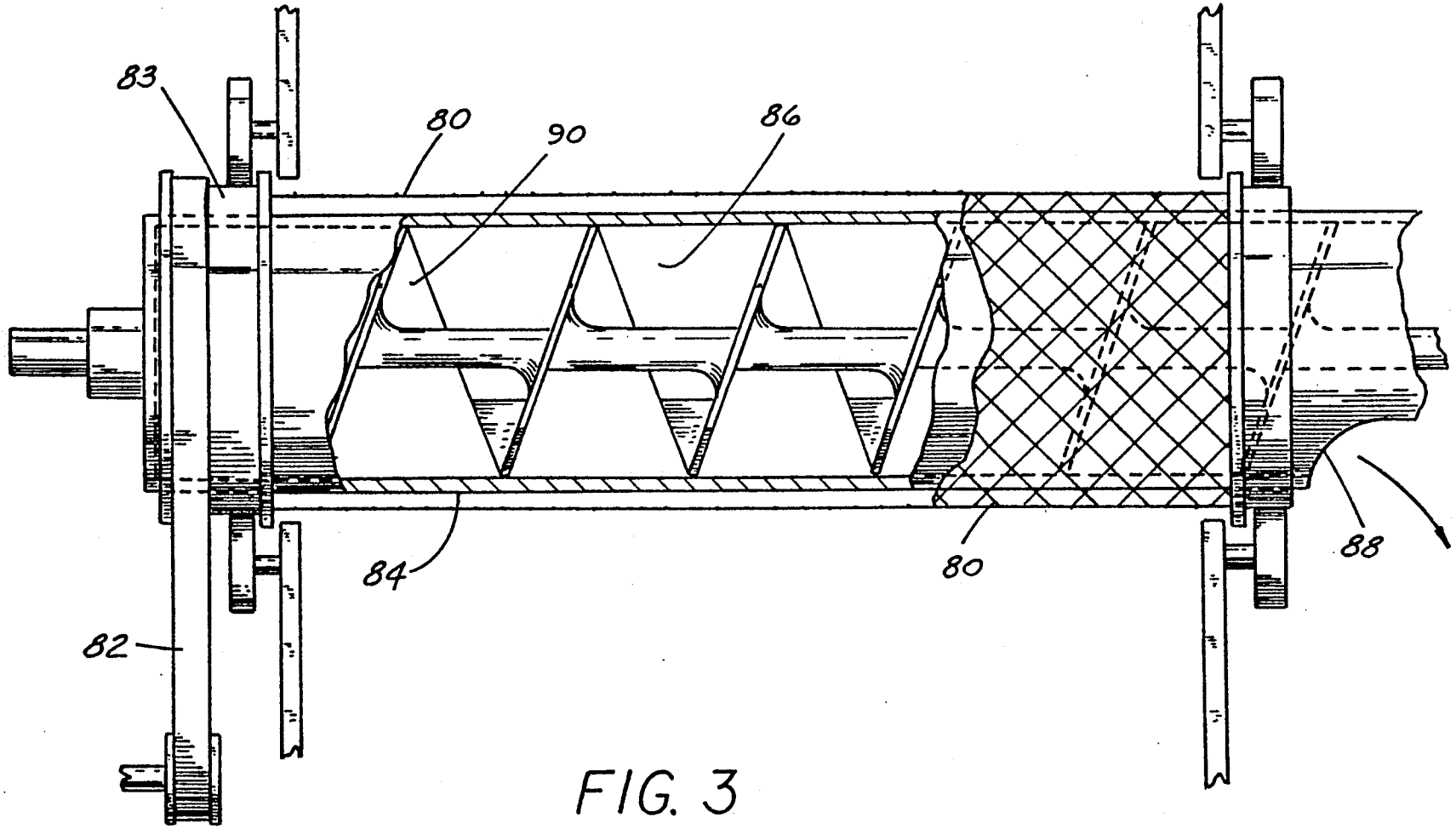
FIG. 3 is a sectional, taken along section 3—3 as indicated in FIG. 2, illustrating details of the moving screen assembly shown in FIG. 2.

Cylindrical screen 80 is part of a screen assembly the details of which are best illustrated in FIGS. 2 and 3. Screen 80 is rotated by a drive belt 82 which engages a screen-mounting collar 83. A variety of other drive means could be used. Screen 80 is rotated such that its movement in the discharge zone is substantially in the direction of discharge. Thus, the flattened rind is received by and carried on screen 80 toward downstream release and pith passes through screen 80 toward a downstream pith collection point.

The screen assembly includes a non-rotatably fixed cylindrical container 84 inside cylindrical screen member 80 positioned for accumulation of pith. Container 84 and screen 80 are in concentric relationship to each other. Container 84 has an opening 86 positioned in the path of primary pith flow to allow pith which passes through screen 80 to be received and collected.

The screen assembly has an open end 88 which allows axial movement of pith out of container 84. A rotating auger 90, coaxial with container 84 and screen 80, is located in container 84 and is rotatable about its axis. This moves milled pith, which has accumulated in fixed container 84, along the axis of cylindrical screen 80 and out end opening 88.

Figure 4:
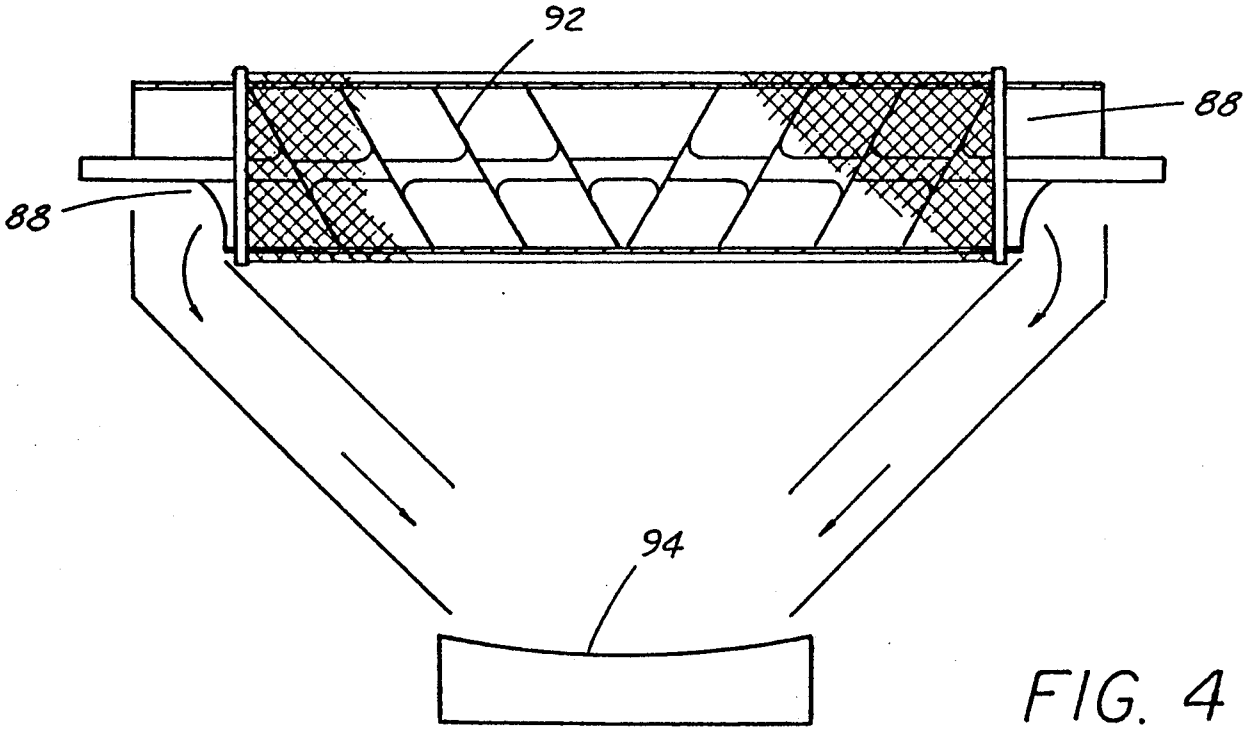
FIG. 4 is a schematic view of an alternative means for removing milled pith from the moving screen assembly.

FIG. 4 shows an alternative arrangement having two open ends 88 and an auger 92 which is configured, on rotation in one rotational direction, to move milled pith in different portions of the container in opposite axial directions toward the opposite open ends 88. FIG. 4 also illustrates a lower collection conveyor 94 which moves milled pith away for subsequent processing.

Flattened rinds and secondary milled pith flow 68 leave rotating screen 80 and move to pith-removal stations 29. These three stations present a series of three rotatable brush rolls 31, each having a coacting feed roll 33. Each brush roll 31 has a bristle portion 31*b* made up of bristle bunches 31*a* with interstices 31*c* therebetween. For each brush roll 31, bristle portion 31*b* is positioned to merge on rotation with secondary milled pith flow 68 and receive pith into interstices 31*c*. The rotation of each brush roll 31 and its corresponding coacting feed roll 33 serves to advance flattened rinds while brush roll 31 captures pith.

Figure 5:
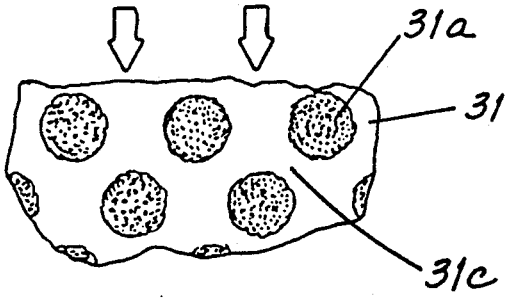
FIG. 5 is a fragmentary schematic view of a surface of a brush roll, showing the bristle pattern.

As shown in FIG. 5, bristle bunches 31*a* on each brush roll 31 are arranged in offset rows. As noted above, this facilitates the capturing of pith as it flows with the rind in a downstream direction.

Downstream of each brush roll 31 is a divider 70 which has a rind side 72 and a pith side 74. Pith side 74 is adjacent to bristle portion 31*b* along an arc which extends away from rind side 72. Rind sides 72 of dividers 70 extend along a common curved path, and bristle portions 31*b* have bristle tips 31*d* which project beyond such curved path so they are positioned to facilitate the capture of pith from the secondary milled pith flow.

The first and third brush rolls 31 rotate at a speed such that their bristle tips 31*d* have a linear speed about equal to the speed of rind flow. The first and third coacting feed rolls 33 have knurled surfaces, not shown, and these two feed rolls rotate at the same linear speed as that of the first and third brush rolls 31. This rotation serves to move flattened rinds along the line. The middle coacting feed roll also rotates at the same speed, but the middle brush roll rotates at a greater linear speed such that its bristle tips brush milled pith from the rinds. The middle feed roll has a toothed surface to perform a hold-back function during such brushing action, preventing acceleration of the rind.

The apparatus of this invention may be made using materials which would be apparent to those skilled in the art who are made aware of this invention. The endless screen, while preferably in the form of rotatable screen 80, may be in other forms. One other possibility is a conveyor belt made of open-mesh screen.

While the principles of this invention have been described in connection with specific embodiments, it should be understood clearly that these descriptions are made only by way of example and are not intended to limit the scope of the invention.

I claim:

1. In a method for separating sugarcane pith from sugarcane rind of the the including splitting sugarcane billets into half billets, milling pith from half billets by passing them between cutter and holdback rolls, and dividing the discharge from such rolls into separate flows of pith and half-billet rings, the improvement comprising:

receiving from said discharge depithed half-billet rinds on an endless moving screen and carrying said half-billet rinds on said screen away from such rolls; and receiving milled pith from said discharge through said endless moving screen, the screen having an open mesh suitable to allow flow of milled pith therethrough and to carry depithed half-billet rinds therein.

2. In a method for separating sugarcane pith from sugarcane rind including splitting sugarcane billets into half billets, milling pith from half billets by passing them between cutter and holdback rolls, and dividing the discharge from such rolls into separate flows of pith and half-billet rinds, the improvement comprising:

receiving from said discharge depithed half-billet rinds on an endless moving screen and carrying said half-billet rinds and a secondary milled pith flow received on said screen away from such rolls;

receiving milled pith from said discharge through said endless moving screen as a primary milled pith flow, the screen having an open mesh suitable to allow flow of milled pith therethrough and to carry depithed halfbillet rinds thereon, thereby dividing the discharge into the primary pith flow and a half-billet rind flow which includes the secondary pith flow; and thereafter removing the secondary pith flow from the half-billet rind flow and diverting the secondary pith flow to join pith from the primary pith flow.

3. The method of claim 2 wherein the removing and diverting step comprises:

capturing the pith from the secondary pith flow in interstices formed within a rotating brush roll bristle portion which merges with the secondary pith flow;

holding such captured pith within the interstices through an arc of brush roll rotation to turn the secondary pith flow away from the ring flow; and releasing such captured pith from the interstices in a direction away from the rind flow.

4. The method of claim 3 wherein the releasing is by centrifugal force on brush roll rotation.

5. The method of claim 4, wherein the removing and diverting step includes capturing in a subsequent similar brush pith from the secondary pith flow which is not captured by the previous brush.

6. In sugarcane separation apparatus having means for splitting billets, opposed cutter and holdback rolls to receive half billets and remove pith from half-billets ends, said rolls defining a discharge zone and a discharge direction, and means to divide the discharge from such rolls into separate flows of pith and half-billets rinds, the improvement comprising:

an endless screen having a pickup portion positioned in the discharge zone, the screen having an open mesh suitable to allow flow of milled pith therethrough and to carry depithed half-billets rinds thereon; and means to rotate the endless screen such that movement thereof in the discharge zone is substantially in the discharge direction, whereby half-billet rinds are received by and carried on the screen toward downstream release therefrom and pith passes trough the screen toward a downstream pith collection point.

7. In a method for separating sugarcane pith from sugarcane rind of the type including splitting sugarcane billets into half billets, milling pith from half billets by passing them between cutter and holdback rolls which form a discharge zone in which pith and half-billet rinds are discharged, and dividing the discharge from such rolls into separate flows of pith and half-billet rinds, the improvement composing: p1 receiving from said discharge depithed half-billet rinds on a rotating hollow cylindrical screen member which has a pickup portion positioned in the discharge zone, and carrying said half-billet rinds on said cylindrical screen member away from such rolls, the pickup portion moving generally in the direction of discharge; and receiving milled pith from said discharge through said screen member, said screen member having an open mesh suitable to allow flow of milled pith therethrough and to carry depithed half-billet rinds thereon.

8. In a method for separating sugarcane pith from sugarcane rind including splitting sugarcane billets into half billets, milling pith from half billets by passing them between cutter and holdback rolls which form a discharge zone in which pith and half-billet rinds are discharged, and dividing the discharge from such rolls into separate flow of pith and half-billets rinds, the improvement comprising:

receiving from said discharge depithed half-billet rinds on a rotating hollow cylindrical screen member which has a pickup portion positioned in the discharge zone, and carrying said half-billet rinds and a secondary milled pith flow received on said cylindrical screen member away from such rolls, the pickup portion moving generally in the direction of discharge;

receiving milled pith from said discharge through said screen member as a primary milled pith flow, said screen member having an open mesh suitable to allow flow of milled pith therethrough and to carry depithed half-billet rinds thereon, thereby dividing the discharge into the primary pith flow and a rind flow which includes the secondary pith flow; and thereafter removing the secondary pith flow from the half-billet rind flow and diverting the secondary pith flow to join pith from the primary pith flow.

9. In sugarcane separation apparatus having means for splitting billets, opposed cutter and holdback rolls to receive half billets and remove pith from half-billet rinds, said rolls defining a discharge zone and a discharge direction, and means to divide the discharge from such rolls into separate flows of pith and half-billets rinds, the improvement comprising:

a hollow cylindrical screen member having a pickup portion positioned in the discharge zone such that the discharge direction is generally tangential thereto, the screen member having an open mesh suitable to allow flow of milled pith therethrough and the carry depithed half-billet rinds thereon; and means to rotate the screen member such that movement of the pickup portion in the discharge zone is substantially in the discharge direction, whereby half-billet rinds are received by and carried on the screen member toward downstream release therefrom and pith passes through the screen member toward a downstream pith collection point.

10. The sugarcane separation apparatus of claim 9 further comprising a fixed container inside the cylindrical screen member for accumulation of pith, such container having an opening for receiving pith through the screen member, the cylindrical member having at least one open end for movement of pith out of the container.

11. The sugarcane separation apparatus of claim 10 further comprising means to move pith which has accumulated in the container along the axis of the cylindrical screen member to outside the cylindrical screen member.

12. The sugarcane separation apparatus of claim 11 wherein the container has a wall partially cylindrical in shape and the moving means is an auger in the container, such auger substantially coaxial with the cylindrical screen member.

13. The sugarcane separation apparatus of claim 12 wherein there are two of the open ends and the auger is configured to move pith in different portions of the container in opposite directions toward both open ends.

14. The sugarcane separation apparatus of claim 9 further comprising a gripping roll peripherally adjacent to the cylindrical screen member to hold rinds on the screen during movement of the rinds with the screen.

15. In sugarcane separation apparatus having means for splitting billets, opposed cutter and holdback rolls to receive half billets and remove pith from half-billet rinds, said rolls defining a discharge zone and a discharge direction, and means to divide the discharge from such rolls into separate flows of pith and half-billet rinds, the improvement comprising:

an endless screen having a pickup portion positioned in the discharge zone, the screen having an open mesh suitable to allow flow of milled pith therethrough as a primary milled pith flow and to carry depithed half-billet rinds and a secondary milled pith flow thereon;

means to rotate the endless screen such that movement of the pickup portion in the discharge zone is substantially in the discharge direction whereby half-billet rinds are carried on the screen toward downstream release therefrom and pith passes through the screen toward a downstream pith collection point; and means downstream of the endless screen to remove the secondary milled pith flow from the half-billet rind flow and divert the secondary pith flow to join pith from the primary pith flow.

16. The sugarcane separation apparatus of claim 15 wherein the removing and diverting means comprises:

at least one rotatable brush roll downstream of the endless screen, each such brush roll having a bristle portion with interstices therein, such bristle portion positioned to merge on rotation with the secondary milled pith flow and receive pith therefrom in the interstices; and a coacting feed roll for each brush roll to advance the rind while the brush roll receives loosened pith therein.

17. The sugarcane separation apparatus of claim 16 wherein the removing and diverting means further includes a divider downstream of each brush roll, the divider having a rind side and a pith side which is adjacent to the bristle portion along an arc away from the rind side, such pith side serving to hold pith in the interstices as it moves away from the rind flow.

18. The sugarcane separation apparatus of claim 17 having a plurality of brush roll, feed roll, and divider sets, the rind sides of the dividers extending along a common curved path, the bristle portions having bristle tips projecting beyond such curved path.

19. The sugarcane separation apparatus of claim 16 further including means to rotate the brush roll and feed roll in the downstream direction to advance the rinds.

20. The sugarcane separation apparatus of claim 19 having a plurality of brush roll, feed roll, and divider sets.

21. The sugarcane separation apparatus of claim 20 wherein the rotation means rotates one of the brush rolls at a speed such that its bristle tips move along the rinds in the direction of rind flow at a linear speed in excess of the speed of the rind flow, whereby pith adhering to the rinds is brushed therefrom.

* * * * *

UNITED STATES PATENT AND TRADEMARK OFFICE
CERTIFICATE OF CORRECTION

PATENT NO. : 5,118,353

DATED : June 2, 1992

INVENTOR(S) : Sydney E. Tilby

It is certified that error appears in the above-identified patent and that said Letters Patent is hereby corrected as shown below:

In column 1, beneath "Background of the Invention", insert the following subheading, --General Background--.

In column 2, line 43, change "312,677" to --4,312,677--.

In column 3, line 29, after "element", insert --as--.

In column 6, line 24, change "&::he" to --the--.

Col. 8, claim 1, line 2, delete "the the" .

Col. 8,
In claim 1, line 6, change "rings." to --rinds,--.

Col. 9,
In claim 2, line 15, change "halfbillet" to --half-billet--.

Col. 9,
In claim 3, line 9, change "ring" to --rind--.

Col. 9,
In claim 5, line 1, change "4." to --4--.

Col. 9,
In claim 6, line 4, change "ends," to --rinds,--.

In claim 6, line 15, change "direction." to --direction,--.

In claim 6, line 18, change "trough" to --through--.

UNITED STATES PATENT AND TRADEMARK OFFICE

CERTIFICATE OF CORRECTION

PATENT NO. : 5,118,353

DATED : June 2, 1992

INVENTOR(S) : Sydney E. Tilby

It is certified that error appears in the above-identified patent and that said Letters Patent is hereby corrected as shown below:

Col. 9,

In claim 7, line 2, delete "of the type".

In claim 7, line 8, delete "pl", and start a new subparagraph, starting with the word "receiving".

Col. 10,

In claim 8, line 7, change "flow" to --flows--. In the same line, change "half-billets" to --half-billet--.

In claim 9, line 4, change "rinds." to --rinds,--.

In claim 9, line 5, change "direction." to --direction,--.

In claim 9, line 13, change "the" to --to--.

Col. 10,

In claim 10, line 3, change "pith." to --pith,--.

UNITED STATES PATENT AND TRADEMARK OFFICE

CERTIFICATE OF CORRECTION

PATENT NO. : 5,118,353

DATED : June 2, 1992

INVENTOR(S) : Sydney E. Tilby

It is certified that error appears in the above-indentified patent and that said Letters Patent is hereby corrected as shown below:

Col. 11,
In claim 15, line 4, change "rinds." to —rinds,—.

In claim 15, line 5, change "direction." to —direction,—.

In claim 16, line 4, change "screen." to —screen,—.
Col. 12,
In claim 17, line 3, change "roll." to —roll,—.

Signed and Sealed this

Third Day of August, 1993

Michael K. Kirk

*Attest:*

MICHAEL K. KIRK

*Attesting Officer*

*Acting Commissioner of Patents and Trademarks*